US009353722B2

(12) United States Patent
Kawai

(10) Patent No.: US 9,353,722 B2
(45) Date of Patent: May 31, 2016

(54) IGNITION COIL FOR INTERNAL COMBUSTION ENGINE

(71) Applicant: DENSO CORPORATION, Kariya, Aichi-ken (JP)

(72) Inventor: Kazuhide Kawai, Kariya (JP)

(73) Assignee: DENSO CORPORATION, Kariya (JP)

( * ) Notice: Subject to any disclaimer, the term of this patent is extended or adjusted under 35 U.S.C. 154(b) by 115 days.

(21) Appl. No.: 14/176,380

(22) Filed: Feb. 10, 2014

(65) Prior Publication Data

US 2014/0226253 A1 Aug. 14, 2014

(30) Foreign Application Priority Data

Feb. 12, 2013 (JP) ..... 2013-024758

(51) Int. Cl.

| | |
|---|---|
| ***F23Q 3/00*** | (2006.01) |
| ***F02P 3/02*** | (2006.01) |
| ***H01F 38/12*** | (2006.01) |

(52) U.S. Cl.

CPC .. *F02P 3/02* (2013.01); *H01F 38/12* (2013.01)

(58) Field of Classification Search

CPC ..... F02P 23/00; F02P 23/02; H01F 27/29; H01F 38/12

See application file for complete search history.

(56) References Cited

U.S. PATENT DOCUMENTS 5,349,320 A * 9/1994 Suzuki et al. ..... 336/92
2013/0284157 A1 10/2013 Deguchi

FOREIGN PATENT DOCUMENTS

| | | |
|---|---|---|
| JP | 03-264776 | 11/1991 |
| JP | 07-086060 | 3/1995 |
| JP | 7-238881 | 9/1995 |
| JP | 2003-092225 | 3/2003 |
| JP | 2003-188034 | 7/2003 |
| JP | 2005-019659 | 1/2005 |
| JP | 2007-299919 | 11/2007 |
| JP | 2008-4732 | 1/2008 |
| JP | 2011-003684 | 1/2011 |
| JP | 2011-77485 | 4/2011 |
| JP | 2013-229484 | 11/2013 |

OTHER PUBLICATIONS

Office Action (3 pgs.) dated Jan. 12, 2016 issued in corresponding Japanese Application No. 2013-024758 with an at least partial English language translation (3 pgs.).

* cited by examiner

*Primary Examiner* — Thienvu Tran
*Assistant Examiner* — Tien Mai
(74) *Attorney, Agent, or Firm* — Nixon & Vanderhye P.C.

(57) ABSTRACT

An ignition coil includes a primary coil, a secondary coil, a center core, a case, and a filler resin. A connection terminal is connected to a high-voltage-side winding end portion of the secondary coil. A cylindrical high-voltage tower section is formed projecting outside the case. A high-voltage terminal connected to the connection terminal is disposed within the high-voltage tower section. The connection terminal has a contacting portion and a conducting portion. The contacting portion comes into contact with the high-voltage terminal. The conducting portion ensures electrical conduction with the high-voltage terminal. The contacting portion comes into contact with and presses against the high-voltage terminal in an axial direction of the high-voltage tower section. The contacting section is pressed against the high-voltage terminal in the axial direction such that the conducting portion is pressed against and placed in contact with the high-voltage terminal in a direction perpendicular to the axial direction.

6 Claims, 6 Drawing Sheets

IGNITION COIL FOR INTERNAL COMBUSTION ENGINE

CROSS-REFERENCE TO RELATED APPLICATION

This application is based on and claims the benefit of priority from earlier Japanese Patent Application No. 2013-024758 filed on Feb. 12, 2013, the description of which is incorporated herein by reference.

BACKGROUND

1. Technical Field

The present invention relates to an ignition coil applicable to an internal combustion engine.

2. Related Art

An ignition coil used in an internal combustion engine, such as an engine, includes a primary coil, a secondary coil, a center core, and the like. The primary coil and the secondary coil are disposed concentrically. The center coil is disposed in an axial-center position of the primary coil and the secondary coil. Constituent components, such as the primary coil, the secondary coil, and the center coil, are housed within a case. Gaps formed in the case are filled with a thermoset resin, such as an epoxy resin.

For example, JP-A-2003-92225 discloses an ignition coil. In the ignition coil, a connection terminal composed of an elastic body is connected to a high-voltage-side winding end portion of the secondary coil. A high-voltage terminal is press-fitted into a high-voltage tower section. The high-voltage tower section has a cylindrical shape and is formed projecting from the case. In the ignition coil, during assembly of the constituent components, such as the secondary coil, into the case, the connection terminal and the high-voltage terminal are placed in contact in an axial direction of the high-voltage tower section. As a result, electrical conduction is ensured between the connection terminal and the high-voltage terminal.

However, the above-described ignition coil in JP-A-2003-92225 has the following issues. In other words, when the constituent components, such as the primary coil, the secondary coil, and the center core, are assembled into the case, the state of contact between the connection terminal and the high-voltage terminal is ensured by contact pressure caused by the elastic force of the connection terminal that is composed of an elastic body. However, after the case is filled with the thermoset resin, such as an epoxy resin, and the thermoset resin is hardened, the connection terminal is confined by the thermoset resin. Therefore, exerting the elastic force of the connection terminal becomes difficult.

In a state such as this, there is an instance in which the linear thermal expansion coefficient of the material configuring the case is greater than the linear thermal expansion coefficient of the thermoset resin, such as an epoxy resin. In this instance, when the ignition coil is mounted in an internal combustion engine and used in a high-temperature environment, the difference in linear thermal expansion coefficient causes displacement of the high-voltage terminal. Specifically, the high-voltage terminal that is press-fitted into the high-voltage tower becomes displaced towards a direction away from the connection terminal in the axial direction of the high-voltage tower.

In addition, there is an instance in which the linear thermal expansion coefficient of the material configuring the case is less than the linear thermal expansion coefficient of the thermoset resin, such as an epoxy resin. In this instance, when the ignition coil is mounted in the internal combustion engine and used in a low-temperature environment, the connection terminal becomes displaced towards a direction away from the high-voltage terminal in the axial direction of the high-voltage tower section.

As a result, even the slightest amount of displacement causes contact failure between the connection terminal and the high-voltage terminal. Electrical conduction between the connection terminal and the high-voltage terminal becomes difficult to ensure. Ignition energy loss and noise increase caused by connection due to micro-discharge, breakdown caused by contact failure, and the like may occur.

SUMMARY

It is thus desired to provide an ignition coil that is capable of sufficiently ensuring electrical conduction between a connection terminal and a high-voltage terminal.

An exemplary embodiment provides an ignition coil includes: a primary coil and a secondary coil that are disposed concentrically; a center core that is disposed in an axial-center position of the primary coil and the secondary coil; a case that houses the primary coil, the secondary coil, and the center core; a filler resin that fills gaps formed within the case and is composed of a thermoset resin; a connection terminal that is composed of an elastic body and is connected to a high-voltage-side winding end portion of the secondary coil; a cylindrical high-voltage tower section that is included in the case, and is formed projecting towards the outer side of the case; and a high-voltage terminal that is disposed within the high-voltage tower section, and is connected to the connection terminal.

The connection terminal has a contacting portion and a conducting portion. The contacting portion comes into contact with the high-voltage terminal. The conducting portion ensures electrical conduction with the high-voltage terminal. The contacting portion of the connection terminal comes into contact with and presses against the high-voltage terminal in an axial direction of the high-voltage tower section. The contacting section is pressed against the high-voltage terminal in the axial direction such that the conducting portion is pressed against and placed in contact with the high-voltage terminal in a direction perpendicular to the axial direction.

In the ignition coil according to the exemplary embodiment, the connection terminal is composed of an elastic body and is connected to the high-voltage-side winding end portion of the secondary coil. The connection terminal has the contacting section that comes into contact with the high-voltage terminal, and the conducting section that ensures electrical conduction with the high-voltage terminal. The high-voltage terminal is disposed within the high-voltage tower section of the case.

The contacting portion of the connection terminal comes into contact with and is pressed against the high-voltage terminal in the axial direction of the high-voltage tower section. The contacting portion is pressed against the high-voltage terminal in the axial direction such that the conducting portion is pressed against and placed in contact with the high-voltage terminal in the direction perpendicular to the axial direction.

In other words, the connection terminal is composed of an elastic body. In addition, in a state in which the contacting portion of the connection terminal is in contact with the high-voltage terminal in the axial direction, the contacting portion is further pressed in the axial direction. The conducting portion of the connection terminal is then pressed against and placed in contact with the high-voltage terminal in the direction perpendicular to the axial direction through use of counter-force accompanying the displacement of the connection terminal. In this way, the connection terminal ensures electrical conduction with the high-voltage terminal.

Here, the above-described instance in related art is considered. In the instance, the ignition coil is mounted in an internal combustion engine and used in a high- or low-temperature environment. Due to difference in linear thermal expansion coefficient between the case and the filler resin filling the inside of the case, the high-voltage terminal or the connection terminal becomes displaced in the axial direction.

Even when such a displacement occurs, the connection terminal and the high-voltage terminal are pressed against and in contact with each other in the direction perpendicular to the axial direction. Therefore, contact between the connection terminal and the high-voltage terminal can be stably ensured.

As a result, contact failure between the connection terminal and the high-voltage terminal, and accompanying conduction failure can be prevented. In other words, electrical conduction between the connection terminal and the high-voltage terminal can be sufficiently ensured.

In this way, an ignition coil for an internal combustion engine can be provided that is capable of sufficiently ensuring electrical conduction between the connection terminal and the high-voltage terminal.

In the ignition coil according to the exemplary embodiment, the contacting section of the connection terminal is in contact with and pressed against the high-voltage terminal in the axial direction of the high-voltage tower section. In other words, in addition to the conducting portion, the contacting portion of the connection terminal is in contact with the high-voltage terminal. The connection terminal ensures electrical conduction with the high-voltage terminal. Here, the expression "the connection terminal being placed in contact with and pressed against the high-voltage terminal in the axial direction" indicates that the pressing force has at least a vector component in the axial direction.

The conducting portion of the connection terminal is pressed against and placed in contact with the high-voltage terminal in the direction perpendicular to the axial direction. Here, the expression "the conducting portion is pressed against and placed in contact with the high-voltage terminal in the direction perpendicular to the axial direction" indicates that the pressing force has at least a vector component in the direction perpendicular to the axial direction.

In the exemplary embodiment, an insertion recessing portion may be provided in the high-voltage terminal such as to be open towards the connection terminal side in the axial direction. The conducting portion of the connection terminal may be inserted into the insertion recessing portion. The conducting portion of the connection terminal may be placed in contact with an inner surface of the insertion recessing portion in a state in which the conducting portion is inserted into the insertion recessing portion of the high-voltage terminal.

In this instance, the connection terminal and the high-voltage terminal can be easily pressed against and placed in contact with each other in the direction perpendicular to the axial direction. Contact between the connection terminal and the high-voltage terminal can be more stably ensured. Therefore, the above-described effects can be effectively achieved. In other words, contact failure between the connection terminal and the high-voltage terminal, and accompanying conduction failure can be prevented. Electrical conduction between the connection terminal and the high-voltage terminal can be sufficiently ensured.

In the exemplary embodiment, a contact projecting portion may be provided in the high-voltage terminal such as to project towards the connection terminal side in the axial direction. The conducting portion of the connection terminal may come into contact with an outer surface of the contact projecting portion of the high-voltage terminal.

In this instance as well, the connection terminal and the high-voltage terminal can be easily pressed against and placed in contact with each other in the direction perpendicular to the axial direction. Contact between the connection terminal and the high-voltage terminal can be more stably ensured. Therefore, the above-described effects can be effectively achieved. In other words, contact failure between the connection terminal and the high-voltage terminal, and accompanying conduction failure can be prevented. Electrical conduction between the connection terminal and the high-voltage terminal can be sufficiently ensured.

For example, a wire rod or a plate member composed of a metal having elasticity can be used as the connection terminal. In addition, the shape of the connection terminal is not limited. Various shapes can be used.

The shape of the high-voltage terminal is not limited to the above-described shape. Various shapes can be used.

In the exemplary embodiment, the case and the filler resin may have a difference in linear thermal expansion coefficient.

In this instance, when the ignition coil is mounted in an internal combustion engine and used in a high-temperature or low-temperature environment, the high-voltage terminal or the connection terminal is displaced in the axial direction due to the difference in linear thermal expansion coefficient between the case and the filler resin.

Therefore, the above-described effects can be effectively achieved. In other words, the connection terminal and the high-voltage terminal can be placed in contact in the direction perpendicular to the axial direction. Contact failure between the connection terminal and the high-voltage terminal, and accompanying conduction failure can be prevented. Electrical conduction between the connection terminal and the high-voltage terminal can be sufficiently ensured.

For example, polyphenylene sulfide (PPS) resin or polybutylene terephthalate (PBT) resin may be used as the material configuring the case.

For example, an epoxy resin may be used as the material (thermoset resin) configuring the filler resin.

DESCRIPTION OF EMBODIMENTS

Embodiments of the present invention will hereinafter be described with reference to the accompanying drawings.

First Embodiment

An ignition coil according to a first embodiment will be described with reference to the drawings.

Figure 1:
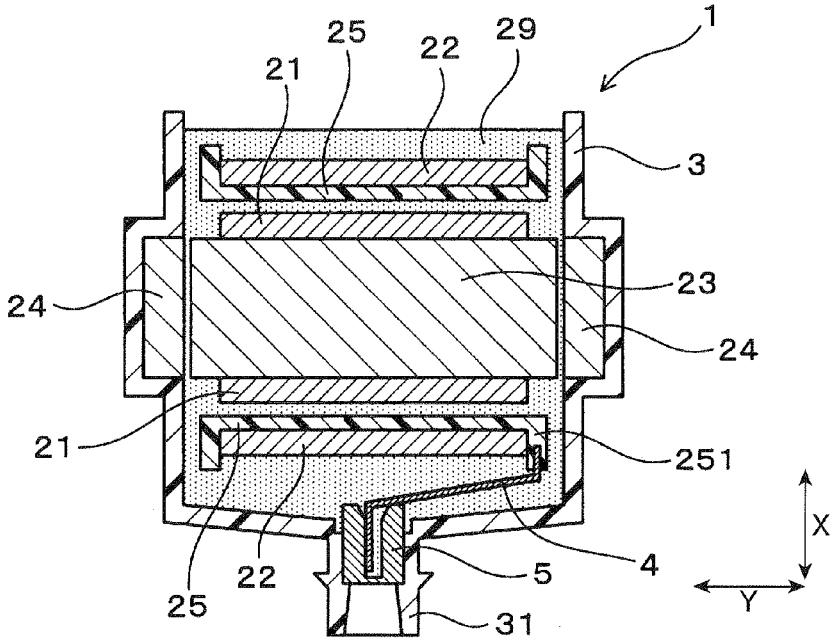
FIG. 1 is a cross-sectional explanatory diagram of a configuration of an ignition coil according to a first embodiment.
Figure 2:
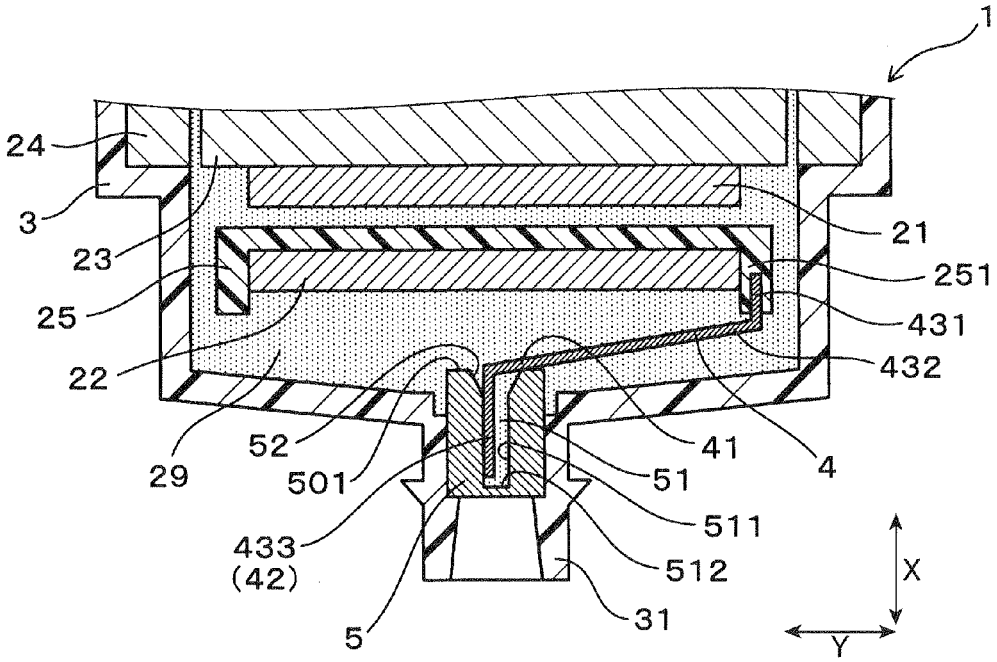
FIG. 2 is a cross-sectional explanatory diagram showing a state of contact between a connection terminal and a high-voltage terminal according to the first embodiment.

As shown in FIG. 1 and FIG. 2, an ignition coil 1 according to the present embodiment includes a primary coil 21, a secondary coil 22, a center core 23, a case 3, and a filler resin 29. The primary coil 21 and the secondary coil 22 are disposed concentrically. The center core 23 is disposed in an axial-center position of the primary coil 21 and the secondary coil 22. The case 3 houses the primary coil 21, the secondary coil 22, and the center core 23. The filler resin 29 is composed of a thermoset resin. Gaps within the case 3 are filled with the filler resin 29.

A connection terminal 4 is connected to a high-voltage-side winding end portion of the secondary coil 22. The connection terminal 4 is composed of an elastic body. The case 3 has a cylindrical high-voltage tower section 31 that projects towards the outer side of the case 3. A high-voltage terminal 5 is disposed within the high-voltage tower section 31. The high voltage terminal 5 is connected to the connection terminal 4.

As shown in FIG. 2, the connection terminal 4 has a contacting portion 41 and a conducting portion 42. The contacting portion 41 comes into contact with the high-voltage terminal 5. The conducting portion 42 ensures electrical conduction with the high-voltage terminal 5.

The contacting portion 41 of the connection terminal 4 comes into contact with and presses against the high-voltage terminal 5 in an axial direction X of the high-voltage tower section 31. As a result of the contacting portion 41 pressing against the high-voltage terminal 5 in the axial direction X, the conducting portion 42 of the connection terminal 4 is pressed against and placed in contact with the high-voltage terminal 5 in a direction Y perpendicular to the axial direction X The foregoing will be described in detail hereafter.

As shown in FIG. 1, the ignition coil 1 is configured by constituent components, such as the primary coil 21, the secondary coil 22, the center core 23, and an outer circumference core 24, being disposed inside the case 3. FIG. 1 shows a state in which the constituent components are assembled into the case 3, at a cross-section viewed from the side.

The primary coil 21 and the secondary coil 22 are disposed concentrically within the case 3. The primary coil 21 is formed into a substantially circular-cylindrical shape by a primary copper wire being wound around the center core 23.

The secondary coil 22 is formed into a substantially circular-cylindrical shape by a secondary copper wire being wound around a secondary spool 25. The secondary copper wire is thinner than the primary copper wire. The number of turns of the secondary copper wire is greater than that of the primary copper wire. The secondary spool 25 is composed of an insulating resin and is disposed on the outer circumferential side of the primary coil 21.

The surfaces of the primary copper wire and the secondary copper wire are covered with an insulating film.

The center core 23 is disposed on the inner circumferential side of the primary coil 21 and the secondary coil 22, in an axial-center position of the primary coil 21 and the secondary coil 22. In addition, the center core 23 is formed into a substantially circular-columnar shape to allow the primary copper wire configuring the primary coil 21 to be wound around the center core 23. Furthermore, the center core 23 is formed by numerous electromagnetic steel plates being stacked. The electromagnetic steel plates are composed of a soft-magnetic material. The center core 23 may also be formed by soft-magnetic material powder being compression molded.

The outer circumference core 24 is disposed on the outer side of the primary coil 21 and the secondary coil 22. The outer circumference core 24, together with the center core 23, configures a magnetic circuit. The outer circumference core 24 is formed into a substantially annular shape such that the center core 23 can be disposed on the inner side. In other words, the outer circumference core 24 is provided such as to cover the outer side of the center core 23.

In addition, the outer circumference core 24 is formed by numerous electromagnetic steel plates being stacked, in a manner similar to the center core 23. The electromagnetic steel plates are composed of a soft-magnetic material. The outer circumference core 24 can also be formed by soft-magnetic material powder being compression-molded.

As shown in FIG. 1 and FIG. 2, the connection terminal 4 is fixed to the high-voltage-side winding end portion of the secondary coil 22. The connection terminal 4 is composed of an elastic body. The connection terminal 4 is configured by a wire rod composed of a metal that has elasticity.

In addition, the connection terminal 4 has a fixed portion 431, an extending portion 432, and a tip portion 433. The fixed portion 431 is fixed to a flange portion 251 on the high-voltage side of the secondary spool 25. The extending portion 432 extends from the fixed portion 431 towards the high-voltage terminal 5. The tip portion 433 is bent from the extending portion 432 and formed in the axial direction X.

In addition, the connection terminal 4 has the contacting portion 41 and the conducting portion 42. The contacting portion 41 is comes into contact with the high-voltage terminal 5. The conducting portion 42 ensures electrical conduction with the high-voltage terminal 5. According to the first embodiment, a portion of the extending portion 432 is the contacting portion 41. The tip portion 433 is the conducting portion 42.

The case 3 is composed of polybutylene terephthalate (PBT) resin. The case 3 has a box shape that is open on one side in the axial direction X. In addition, the case 3 has the cylindrical high-voltage tower section 31. The high-voltage tower section 31 is formed such as to project from a bottom portion of the case 3 towards the outer side.

In addition, the axial direction X of the high-voltage tower section 31 has a perpendicular positional relationship to the winding axial direction of the primary coil 21 and the secondary coil 22. The circular-columnar high-voltage terminal 5 is disposed within the high-voltage tower section 31 by being press-fitted therein.

An insertion recessing portion 51 is provided on an end surface 501 of the high-voltage terminal 5 on the connection terminal 4 side in the axial direction X. The conducting portion 42 of the connection terminal 4 is inserted into the insertion recessing portion 51. The insertion recessing portion 51 is formed such as to be open on the connection terminal 4 side in the axial direction X. An inner diameter of the insertion recessing portion 51 is greater than the outer diameter of the connection terminal 4.

In addition, a beveled portion 52 is provided between the end surface 501 of the high-voltage terminal 5 and an inner surface 511 of the insertion recessing section 51. The beveled portion 52 is provided to smoothly guide the conducting portion 42 of the connection terminal 4 into the insertion recessing portion 51.

As shown in FIG. 2, the contacting portion 41 (corresponding to a portion of the extending portion 432) of the connection terminal 4 comes into contact with and presses against the end surface 501 of the high-voltage terminal 5 in the axial direction X. In addition, as a result of the contacting portion 41 pressing against the end surface 501 of the high-voltage terminal 5 in the axial direction X, the conducting portion 42 (corresponding to the tip portion 433) of the connection terminal 4 is pressed against and placed in contact with the high-voltage terminal 5 in the direction Y perpendicular to the axial direction X.

Specifically, in a state in which the conducting portion 42 (corresponding to the tip portion 433) is inserted into the insertion recessing portion 51 of the high-voltage terminal 5, the conducting portion 42 (corresponding to the tip portion 433) is pressed against and placed in contact with the inner surface 511 of the insertion recessing portion 51 in the direction Y perpendicular to the axial direction X.

In addition, as shown in FIG. 1, an igniter (not shown) is disposed within the case 3. The igniter includes a switching control circuit for sending and blocking current to the primary coil 21. A connector section (not shown) is provided in a position adjacent to the igniter. The connector section is used to connect a conduction terminal of the igniter to an external device, such as an electronic control unit (ECU). A conduction terminal of the connector section is joined with the conduction terminal of the igniter.

In addition, as shown in FIG. 1, gaps within the case 3 housing the constituent components, such as the primary coil 21, the secondary coil 22, the center core 23, and the outer circumference core 24, are filled with the filler resin 29. The filler resin 29 is composed of an epoxy resin that is a thermoset resin.

In addition, the filler resin 29 fixes the constituent components, such as the primary coil 21, the secondary coil 22, the center core 23, and the outer circumference core 24, within the case 3 in an insulated state. The linear thermal expansion coefficient of the case 3 (PBT resin) is greater than the linear thermal expansion coefficient of the filler resin 29 (epoxy resin).

Next, a method for manufacturing the ignition coil 1 according to the first embodiment will be described.

Figure 3:
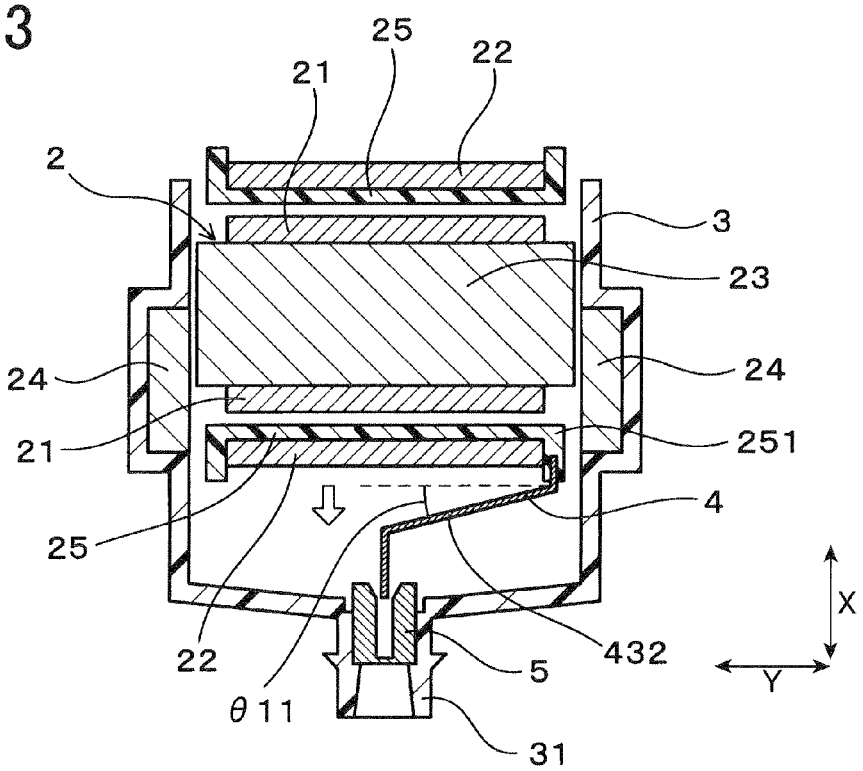
FIG. 3 is a cross-sectional explanatory diagram showing assembly of a winding member into a case, according to the first embodiment.

First, as shown in FIG. 3, the outer circumference core 24 and the high-voltage terminal 5 are assembled into the case 3 in advance. A winding member 2 is formed by assembling the primary coil 21, the secondary coil 22, the center core 23, the secondary spool 25, and the like. The winding member 2 is then inserted from the opening portion of the case 3 and disposed within the case 3. At this time, a tilt angle of the extending portion 432 of the connection terminal 4 in relation to the direction Y perpendicular to the axial direction X is θ11.

Figure 4:
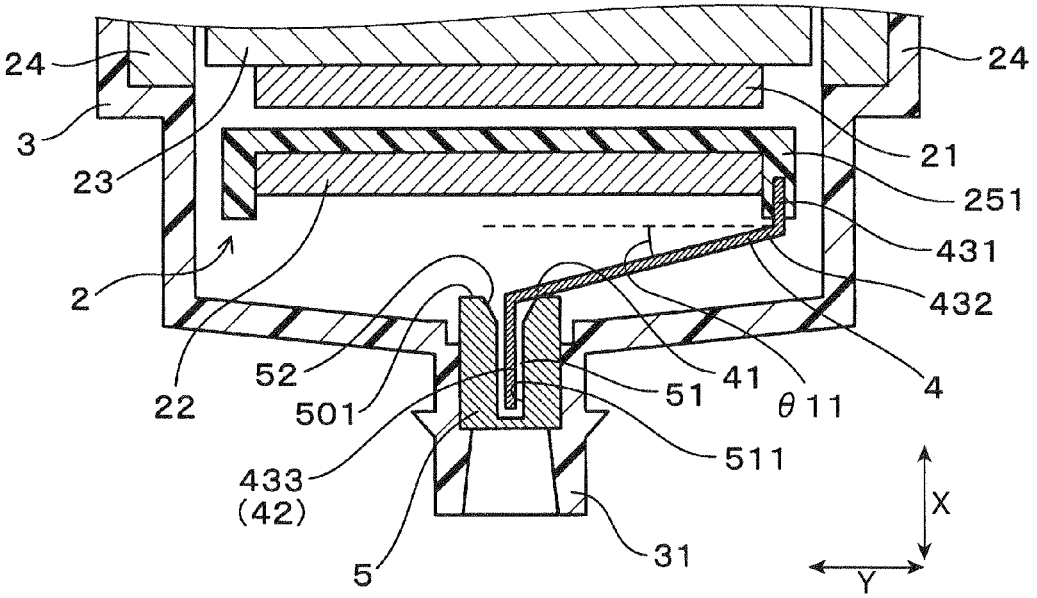
FIG. 4 is a cross-sectional explanatory diagram showing a state in which a contacting portion of the connection terminal is in contact with the high-voltage terminal in an axial direction, according to the first embodiment.

Next, as shown in FIG. 4, the winding member 2 is moved towards the high-voltage terminal 5 side in the axial direction X. The conducting portion 42 (corresponding to the tip portion 433) of the connection terminal 4 is inserted into the insertion recessing portion 51 of the high-voltage terminal 5.

Then, the contacting portion 41 (corresponding to a portion of the extending portion 432) of the connection terminal 4 is placed in contact with the end surface 501 of the high-voltage terminal 5 in the axial direction X. At this time, the tilt angle of the extending portion 432 of the connection terminal 4 in relation to the direction Y perpendicular to the axial direction X is still θ11.

Figure 5:
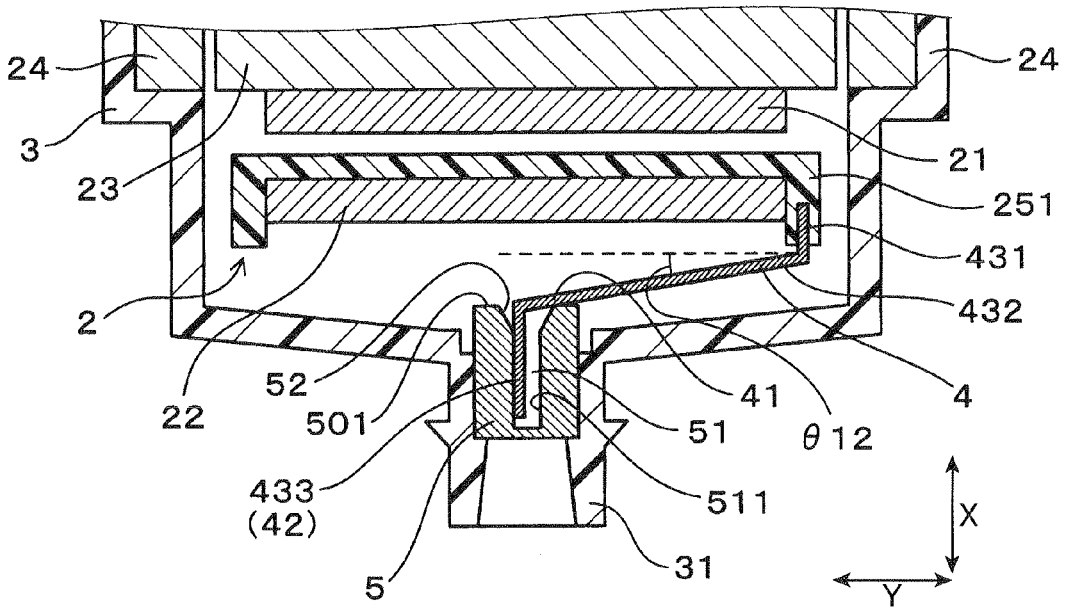
FIG. 5 is a cross-sectional explanatory diagram showing a state in which the contacting portion of the connection terminal is pressed against the high-voltage terminal in the axial direction, according to the first embodiment.

Next, as shown in FIG. 5, in a state in which the contacting portion 41 (corresponding to a portion of the extending portion 432) of the connection terminal 4 is in contact with the end surface 501 of the high-voltage terminal 5 in the axial direction X, the contacting portion 41 is further pressed in the axial direction X. As a result, the tilt angle of the extending portion 432 of the connection terminal 4 in relation to the direction Y perpendicular to the axial direction X becomes θ12 (θ12<θ11).

In accompaniment, the position of the conducting portion 42 (corresponding to the tip portion 433) of the connection terminal 4 becomes displaced towards the direction Y perpendicular to the axial direction X. Then, the conducting portion 42 (corresponding to the tip portion 433) is pressed against and placed in contact with the inner surface 511 of the insertion recessing portion 51 of the high-voltage terminal 5 in the direction Y perpendicular to the axial direction X.

Next, the gaps formed within the case 3 are filled with the epoxy resin which is a thermoset resin. The epoxy resin is then heat-hardened. As a result, the constituent components, such as the primary coil 21, the secondary coil 22, the center core 23, the outer circumference core 24, the secondary spool 25, the connection terminal 4, and the high-voltage terminal 5, are fixed by the filler resin 29 in an insulated state.

The ignition coil 1 shown in FIG. 1 and FIG. 2 is obtained in the above-described manner.

Next, working effects of the ignition coil 1 according to the first embodiment will be described.

In the ignition coil 1 according to the first embodiment, the connection terminal 4 composed of an elastic body is connected to the high-voltage-side winding end portion of the secondary coil 22. The connection terminal 4 has the contacting portion 41 and the conducting portion 42. The contacting portion 41 is in contact with the high-voltage terminal 5. The high-voltage terminal 5 is disposed within the high-voltage tower section 31 of the case 3. The conducting portion 42 ensures electrical conduction with the high-voltage terminal 5.

The contacting portion 41 of the connection terminal 4 comes into contact with and presses against the high-voltage terminal 5 in the axial direction X. As a result of the contacting portion 41 pressing against the high-voltage terminal 5 in the axial direction X, the conducting portion 42 is pressed against and placed in contact with the high-voltage terminal 5 in the direction Y perpendicular to the axial direction X.

In other words, the connection terminal 4 is configured by an elastic body. In addition, in a state in which the contacting portion 41 of the connection terminal 4 is in contact with the high-voltage terminal 5 in the axial direction X, the contacting portion 41 is further pressed against the high-voltage terminal 5 in the axial direction X. The conducting portion 42 of the connection terminal 4 is then pressed against and placed in contact with the high-voltage terminal 5 in the direction Y perpendicular to the axial direction X through use of counter-force accompanying the displacement of the connection terminal 4. In this way, the connection terminal 4 ensures electrical conduction with the high-voltage terminal 5.

Here, the instance in related art as described above is considered. In this instance, the ignition coil 1 is mounted in an internal combustion engine and used in a high- or low-temperature environment. Due to the difference in linear thermal expansion coefficient between the case 3 and the filler resin 29 filling the inside of the case 3, the high-voltage terminal 5 or the connection terminal 4 become displaced in the axial direction X.

In the first embodiment, even when such a displacement occurs, the connection terminal 4 and the high-voltage terminal 5 are pressed against and in contact with each other in the direction Y perpendicular to the axial direction X. Therefore, contact between the connection terminal 4 and the high-voltage terminal 5 can be stably ensured.

As a result, contact failure between the connection terminal 4 and the high-voltage terminal 5, and accompanying conduction failure can be prevented. In other words, electrical conduction between the connection terminal 4 and the high-voltage terminal 5 can be sufficiently ensured.

According to the first embodiment, the linear thermal expansion coefficient of the case 3 is greater than the linear thermal expansion coefficient of the filler resin 29. Therefore, displacement of the high-voltage terminal 5 when the ignition coil 1 is used in a high-temperature environment becomes an issue. The first embodiment can solve this issue.

In addition, according to the first embodiment, the insertion recessing portion 51 is provided in the high-voltage terminal 5 such as to be open towards the connection terminal 4 side in the axial direction X. The conducting portion 42 of the connection terminal 4 is inserted into the insertion recessing portion 51. In addition, the conducting portion 42 of the connection terminal 4 is placed in contact with the inner surface 511 of the insertion recessing portion 51 in a state in which the conducting portion 42 is inserted into the insertion recessing portion 51 of the high-voltage terminal 5.

Therefore, the connection terminal 4 and the high-voltage terminal 5 can be easily pressed against and placed in contact with each other in the direction Y perpendicular to the axial direction X. Contact between the connection terminal 4 and the high-voltage terminal 5 can be more stably ensured.

As described above, according to the first embodiment, the ignition coil 1 for an internal combustion engine can be provided that is capable of sufficiently ensuring electrical conduction between the connection terminal 4 and the high-voltage terminal 5.

According to the first embodiment, as shown in FIG. 1 and FIG. 2, a portion of the extending portion 432 of the connection terminal 4 is configured as the contacting portion 41. The contacting portion 41 is placed in contact with the end surface 501 of the high-voltage terminal 5 in the axial direction X. However, for example, a configuration is also possible in which the tip of the tip portion 433 of the connection terminal 4 is the contacting portion 41. In this instance, the contacting portion 41 can be placed in contact with a bottom surface 512 (see FIG. 2) of the insertion recessing portion 51 of the high-voltage terminal 5 in the axial direction.

According to the first embodiment, as shown in FIG. 3, the outer circumference core 24 is assembled into the case 3 in advance. The winding member 2 is then inserted into and disposed within the case 3. However, for example, the outer circumference core 24 may be assembled and integrated with the winding member 2 in advance. The integrated outer circumference core 24 and winding member 2 may then be inserted into and disposed within the case 3.

Second Embodiment

Figure 6:
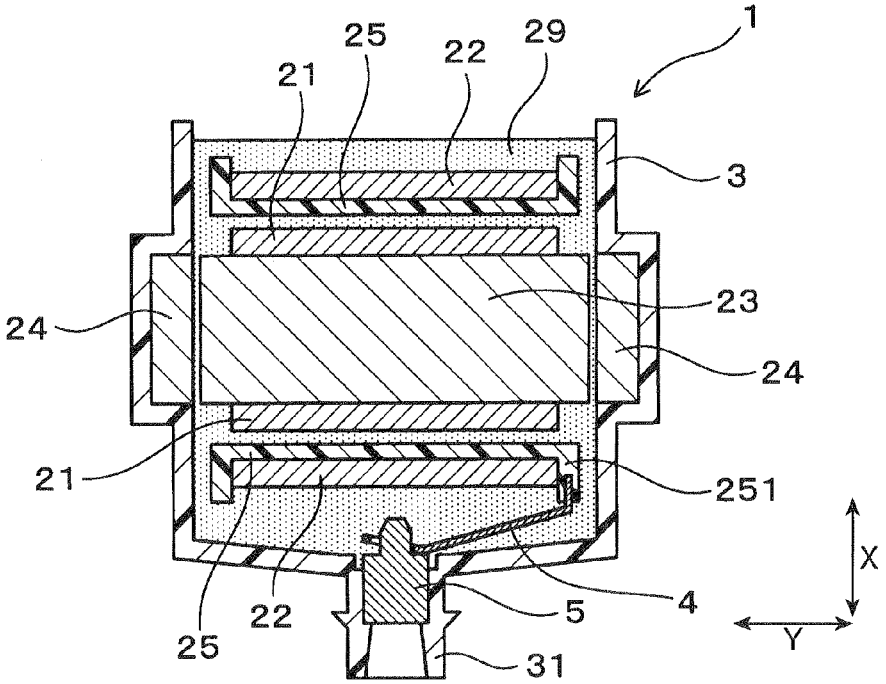
FIG. 6 is a cross-sectional explanatory diagram of a configuration of an ignition coil according to a second embodiment.
Figure 7:
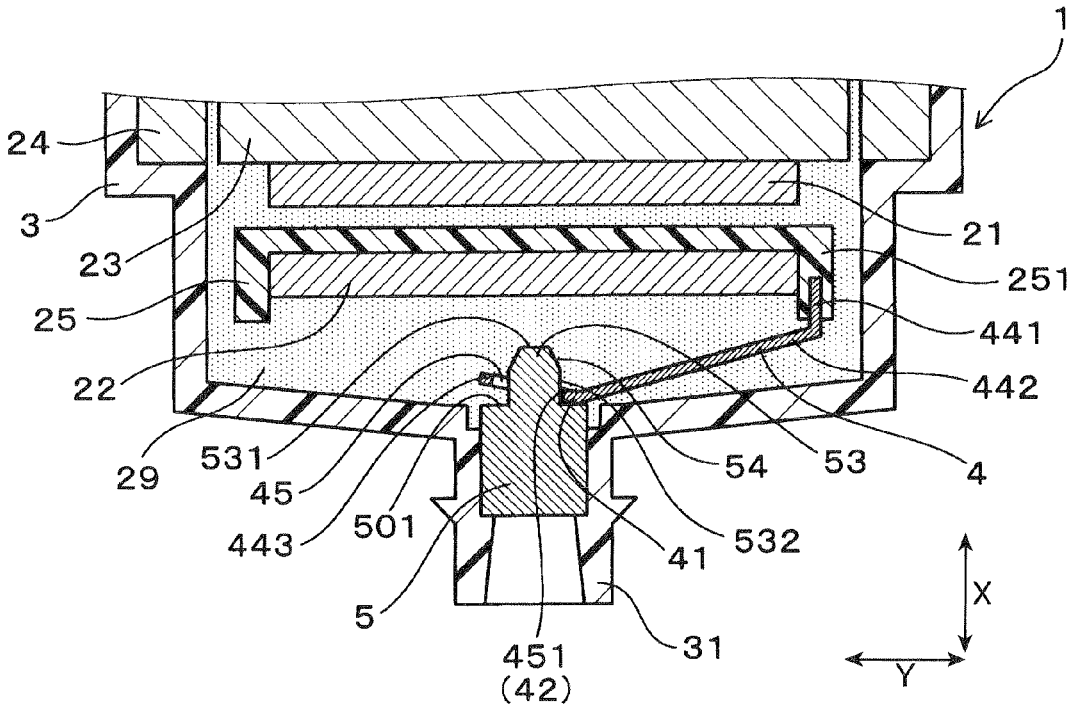
FIG. 7 is a cross-sectional explanatory diagram showing a state of contact between a connection terminal and a high-voltage terminal according to the second embodiment.
Figure 8:
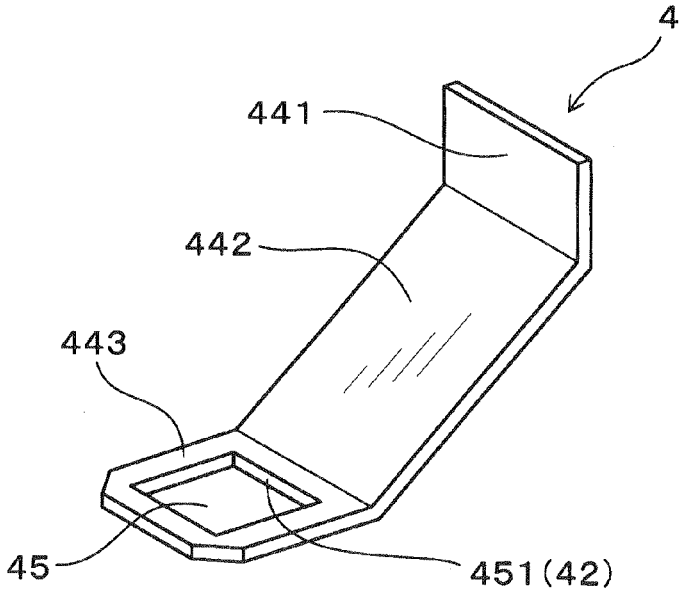
FIG. 8 is a perspective view of a shape of the connection terminal according to the second embodiment.

A second embodiment is an example in which the configurations of the connection terminal 4 and the high-voltage terminal 5 in the ignition coil 1 are modified, as shown in FIG. 6 to FIG. 8.

As shown in FIG. 6 to FIG. 8, the connection terminal 4 is configured by a plate member composed of a metal having elasticity. In addition, the connection terminal 4 has a fixed portion 441, an extending portion 442, and a tip portion 443.

The fixed portion 411 is fixed to the flange portion 251 on the high-voltage side of the secondary spool 25. The extending portion 442 extends from the fixed portion 441 towards the high-voltage terminal 5. The tip portion 443 is bent from the extending portion 442 and formed in the direction Y perpendicular to the axial direction X. A through hole 45 is provided in the tip portion 443. A contact projecting portion 53 of the high-voltage terminal 5, described hereafter, is inserted into the through hole 45.

According to the second embodiment, a portion of the tip portion 443 (corresponding to a portion surrounding the through hole 45) configures the contact portion 41. The inner surface 451 of the through hole 45 in the tip portion 443 configures the conducting portion 42.

In addition, as shown in FIG. 6 and FIG. 7, the contact projecting portion 53 is provided on the end surface 501 of the high-voltage terminal 5, on the connection terminal 4 side in the axial direction X. The contact projecting portion 53 is formed such as to project from the end surface 501 towards the connection terminal 4 side in the axial direction X. The outer diameter of the contact projecting portion 53 is smaller than the inner diameter of the through hole 45 in the tip portion 443 of the connection terminal 4.

In addition, a beveled portion 54 is provided between a tip surface 531 and an outer surface 532 of the contact projecting portion 53. The beveled portion 54 is provided to allow the contact projecting portion 53 of the high-voltage terminal 5 to be smoothly inserted into the through hole 45 in the tip portion 443 of the connection terminal 4.

As shown in FIG. 7, the contacting portion 41 (corresponding to a portion of the tip portion 443 surrounding the through hole 45) of the connection terminal 4 comes into contact with and presses against the end surface 501 of the high-voltage terminal 5 in the axial direction X.

In addition, as a result of the contacting portion 41 pressing against the end surface 501 of the high-voltage terminal 5 in the axial direction X, the conducting portion 42 (the inner surface 451 of the through hole 45 in the tip portion 443) of the connection terminal 4 in the direction Y perpendicular to the axial direction X.

Specifically, in a state in which the contact projecting portion 53 of the high-voltage terminal 5 is inserted into the through hole 45 in the tip portion 443, the conducting portion 42 (the inner surface 451 of the through hole 45 in the tip portion 443) is pressed against and placed in contact with the outer surface 532 of the contact projecting portion 53 in the direction Y perpendicular to the axial direction X.

Other basic configurations are similar to those according to the first embodiment. In addition, configurations similar to those according to the first embodiment are given the same reference numbers. Descriptions thereof are omitted.

Next, a method for manufacturing the ignition coil 1 according to the second embodiment will be described.

Figure 9:
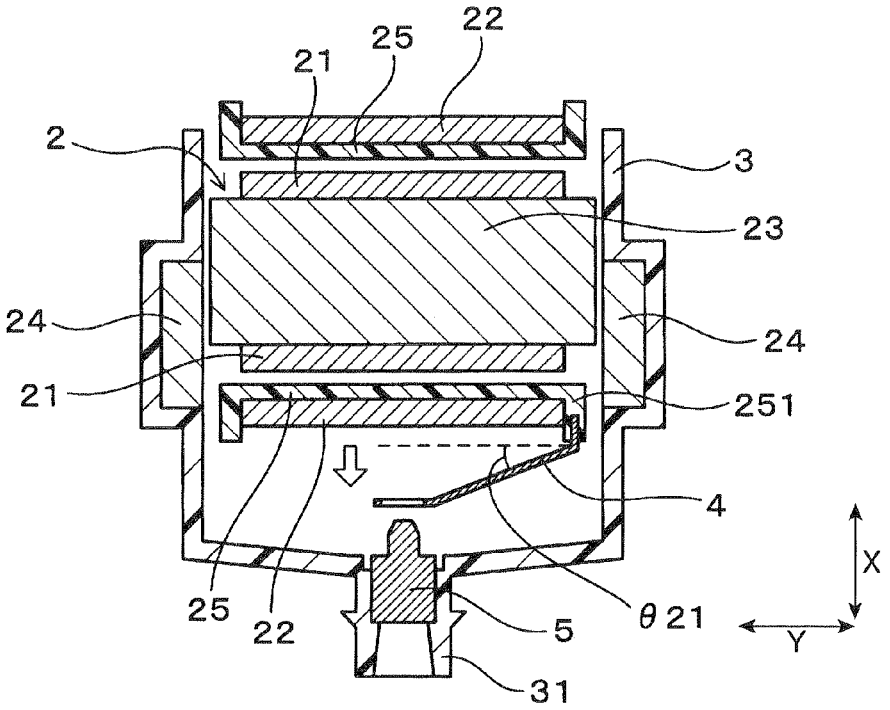
FIG. 9 is a cross-sectional explanatory diagram showing assembly of a winding member into a case, according to the second embodiment.

First, as shown in FIG. 9, the outer circumference core 24 and the high-voltage terminal 5 are assembled into the case 3 in advance. The winding member 2 is formed by assembling the primary coil 21, the secondary coil 22, the center core 23, the secondary spool 25, and the like. The winding member 2 is then inserted from the opening portion of the case 3 and disposed within the case 3. At this time, a tilt angle of the extending portion 442 of the connection terminal 4 in relation to the direction Y perpendicular to the axial direction X is θ21.

Figure 10:
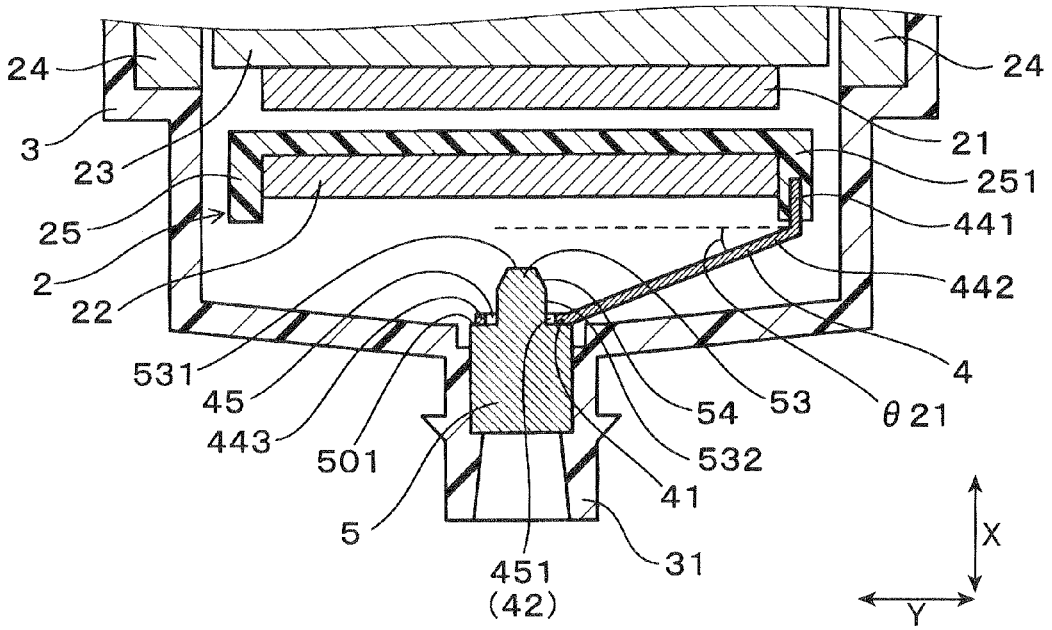
FIG. 10 is a cross-sectional explanatory diagram showing a state in which a contacting portion of the connection terminal is in contact with the high-voltage terminal in an axial direction, according to the second embodiment.

Next, as shown in FIG. 10, the winding member 2 is moved towards the high-voltage terminal 5 side in the axial direction X. The contact projecting portion 53 of the high-voltage terminal 5 is inserted into the through hole 45 in the tip portion 443 of the connection terminal 4.

Then, the contacting portion 41 (a portion of the tip portion 443 surrounding the through hole 45) of the connection terminal 4 is placed in contact with the end surface 501 of the high-voltage terminal 5 in the axial direction X. At this time, the tilt angle of the extending portion 442 of the connection terminal 4 in relation to the direction. Y perpendicular to the axial direction X is still θ21.

Figure 11:
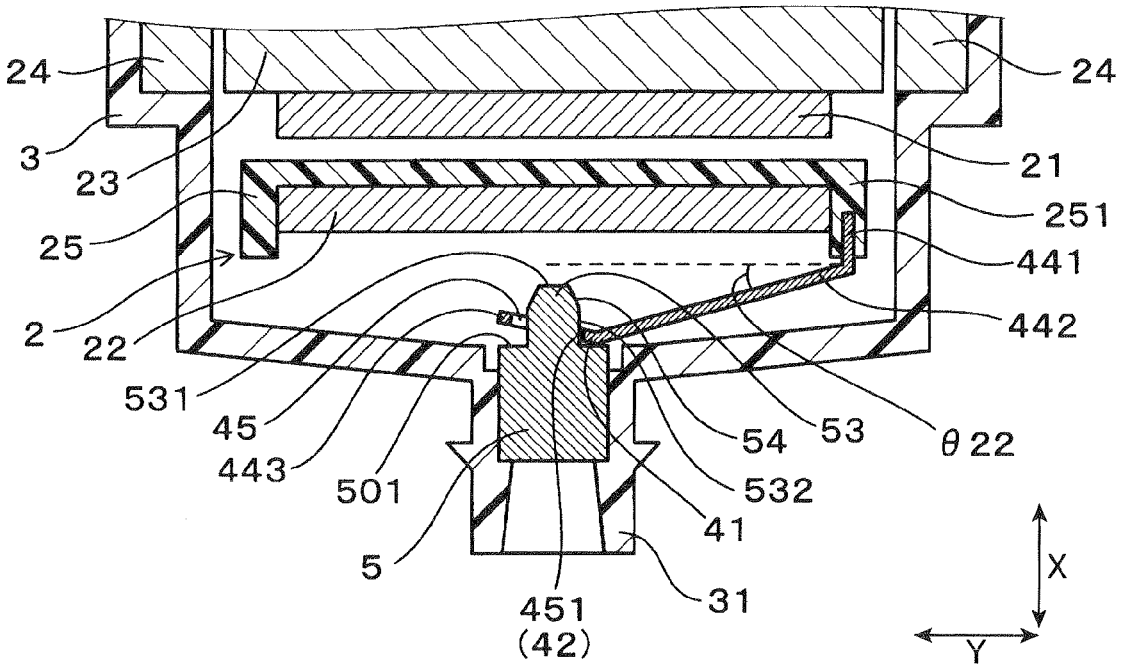
FIG. 11 is a cross-sectional explanatory diagram showing a state in which the contacting portion of the connection terminal is pressed against the high-voltage terminal in the axial direction, according to the second embodiment.

Next, as shown in FIG. 11, in a state in which the contacting portion 41 (a portion of the tip portion 443 surrounding the through hole 45) of the connection terminal 4 is in contact with the end surface 501 of the high-voltage terminal 5 in the axial direction X, the contacting portion 41 is further pressed in the axial direction X.

As a result, the tilt angle of the extending portion 442 of the connection terminal 4 in relation to the direction Y perpendicular to the axial direction X becomes θ22 (θ22<θ21). In accompaniment, the position of the tip portion 443 of the connection terminal 4 becomes displaced in the direction Y perpendicular to the axial direction X.

Then, the conducting portion 42 (the inner surface 451 of the through hole 45 in the tip portion 443) is pressed against and placed in contact with the outer surface 532 of the contact projecting portion 53 of the high-voltage terminal 5 in the direction Y perpendicular to the axial direction X.

Next, the gaps formed within the case 3 are filled with the epoxy resin which is a thermoset resin. The epoxy resin is then heat-hardened. As a result, the constituent components, such as the primary coil 21, the secondary coil 22, the center core 23, the outer circumference core 24, the secondary spool 25, the connection terminal 4, and the high-voltage terminal 5, are fixed by the filler resin 29 in an insulated state.

The ignition coil 1 shown in FIG. 6 and FIG. 7 is obtained in the above-described manner.

Next, working effects of the ignition coil 1 according to the second embodiment will be described.

In the ignition coil 1 according to the second embodiment, the contact projecting portion 53 is provided in the high-voltage terminal 5 such as to project towards the connection terminal 4 side in the axial direction X. In addition, the conducting portion 42 of the connection terminal 4 is in contact with the outer surface 532 of the contact projecting portion 53 of the high-voltage terminal 5.

Therefore, the connection terminal 4 and the high-voltage terminal 5 can be easily pressed against and placed in contact with each other in the direction Y perpendicular to the axial direction X. Contact between the connection terminal 4 and the high-voltage terminal 5 can be more stably ensured.

Other basic working effects are similar to those according to the first embodiment.

According to the second embodiment, as shown in FIG. 8, the through hole 45 is provided in the tip portion 443 of the connection terminal 4. The inner surface 451 (conducting portion 42) of the through hole 45 is placed in contact with the contact However, for example, a configuration is possible in which a notched portion is provided in the tip portion 443 of the connection terminal by notching a portion of the tip portion 443. The inner surface of the notched portion can then serve as the conducting portion 42 and be placed in contact with the contact projecting portion 53 of the high-voltage terminal 5.

What is claimed is:

1. An ignition coil comprising:

a primary coil and a secondary coil that are disposed concentrically;

a center core that is disposed in an axial-center position of the primary coil and the secondary coil;

a case that houses the primary coil, the secondary coil, and the center core;

a filler resin that fills gaps formed within the case, the filler resin being composed of a thermoset resin:

a connection terminal that is composed of an elastic body, the connection terminal being connected to a high-voltage-side winding end portion of the secondary coil;

a cylindrical high-voltage tower section that is disposed in the case, the high-voltage tower section projecting outside the case; and a high-voltage terminal that is disposed within the high-voltage tower section, the high-voltage terminal being connected to the connection terminal, the connection terminal having a contacting portion and a conducting portion, the contacting portion coming into contact with the high-voltage terminal, the conducting portion ensuring electrical conduction with the high-voltage terminal, the contacting portion of the connection terminal coming into contact with and pressing against the high-voltage terminal in an axial direction of the high-voltage tower section, the contacting section being pressed against the high-voltage terminal in the axial direction such that the conducting portion of the connection terminal is pressed against and placed in contact with the high-voltage terminal in a direction perpendicular to the axial direction.

2. The ignition coil according to claim 1, wherein:

the high-voltage terminal is provided with an insertion recessing portion that opens towards a side of the connection terminal in the axial direction and allows the conducting portion of the connection terminal to be inserted into the insertion recessing portion; and the conducting portion of the connection terminal is placed in contact with an inner surface of the insertion recessing portion in a state in which the conducting portion is inserted into the insertion recessing portion of the high-voltage terminal.

3. The ignition coil according to claim 1, wherein:

the high-voltage terminal is provided with a contact projecting portion that projects towards a side of the connection terminal in the axial direction; and the conducting portion of the connection terminal comes into contact with an outer surface of the contact projecting portion of the high-voltage terminal.

4. The ignition coil according to claim 1, wherein:

the case and the filler resin are different from each other in linear thermal expansion coefficient.

5. The ignition coil according to claim 2, wherein:

the case and the filler resin are different from each other in linear thermal expansion coefficient.

6. The ignition coil according to claim 3, wherein:

the case and the filler resin are different from each other in linear thermal expansion coefficient.

* * * * *